United States Patent [19]

Kondo et al.

[11] 4,060,892

[45] Dec. 6, 1977

[54] CUTTER FOR SEMICYLINDRICALLY CURLED PAPER

[75] Inventors: Takajiro Kondo, Yasugi; Toshitaka Asamoto, Matsue; Tsutomu Oki, Yasugi, all of Japan

[73] Assignee: Hitachi Metals, Ltd., Japan

[21] Appl. No.: 546,691

[22] Filed: Feb. 3, 1975

[30] Foreign Application Priority Data

Nov. 1, 1974 Japan ..... 49-125522

[51] Int. Cl.[2] ..... B26B 13/00

[52] U.S. Cl. ..... 30/253; 30/229; 83/607

[58] Field of Search ..... 30/178, 229, 253, 244, 30/249, 250, 252, 253, 259; 83/176, 607, 608, 609

[56] References Cited

U.S. PATENT DOCUMENTS

| | | | |
|---|---|---|---|
| 11,734 | 9/1854 | Stockton | 83/607 |
| 378,004 | 2/1888 | Heaton et al. | 30/253 X |
| 530,059 | 11/1894 | Thompson | 83/609 X |
| 589,101 | 8/1897 | Scholes | 30/94 |
| 1,085,793 | 2/1914 | Boettger | 30/253 |
| 2,204,736 | 6/1940 | Straubel | 83/176 |
| 2,255,812 | 9/1941 | Rickman | 30/229 UX |
| 2,582,933 | 1/1952 | Nielson | 83/607 |
| 3,703,116 | 11/1972 | Doll | 83/176 |

FOREIGN PATENT DOCUMENTS

| | | | |
|---|---|---|---|
| 20,342 | 6/1905 | Austria | 30/95 |
| 21,768 of | 10/1902 | United Kingdom | 83/607 |

*Primary Examiner*—Al Lawrence Smith
*Assistant Examiner*—J. T. Zatarga
*Attorney, Agent, or Firm*—Craig & Antonelli

[57] ABSTRACT

A cutter, simple in construction but having good cutting quality and durability, for cutting paper in a semicylindrically curled state. With radii equal to or approximate to the radius of curvature of the paper to be cut, a stationary blade having a semicircular receding contour and a movable blade having an at least semicircular extending contour are spring-biased into pressure contact edgewise. The distance between the centers of the blades is greater than the difference between the blade radii so that the movable blade can always move in contact at only one point with the stationary blade during cutting operation.

1 Claim, 11 Drawing Figures

CUTTER FOR SEMICYLINDRICALLY CURLED PAPER

BACKGROUND OF THE INVENTION

This invention relates to a cutter for recording paper or film (hereinafter called "paper") in a semicylindrically curled state for use with a copying machine, facsimile, or the like which scans an original or subject copy placed round a rotary drum and converts the scanned image or data into electrical signals for reproduction and recording on paper by itself or by a separate unit.

Conventional cutters of this character comprise, as shown in FIG. 1, a stationary support 1 having a semicircular recess of the same radius of curvature as that of semicylindrically curled paper 0 to be cut, and a small disc-shaped tool 2 secured to a rotating stem 3 so as to be rotated while being pressed edgewise against the stationary support to cut off the paper into two sheets. A common disadvantage of those cutters, which thus depend on the direct, strong pressure contact of the tool edge with the stationary support for the cutting action, has been that either of the cutter components or the both are rapidly worn out.

SUMMARY OF THE INVENTION

This invention is directed to the elimination of the foregoing disadvantage of the conventional cutters and to the provision of a more durable and reliable device for cutting semicylindrically curled paper, with a construction such that a stationary blade having a semicircular receding contour and a movable blade having a correspondingly rounded contour, with radii equal to or approximate to the radius of curvature of the paper to be cut, are pressed into contact edgewise by spring means, the distance between the centers of radii of the stationary and movable blades being greater than the difference between the radii of the blades so that the turnable blade always moves in contact at numerous points with the fixed one during the cutting operation but, at only one point, during each instant of the cutting operation.

DESCRIPTION OF THE PREFERRED EMBODIMENTS

Figure 1:
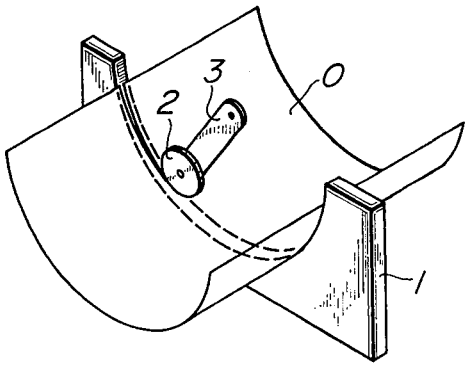
FIG. 1 PRIOR ART
FIG. 1 is a perspective view of a prior art cutter.
Figure 2:
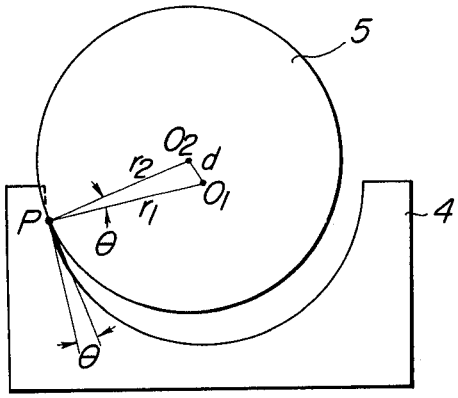
FIG. 2 is a schematic view illustrating how the blades of a cutter according to the present invention are held in contact.

Referring now to FIG. 2, the contact between a stationary blade 4 and a movable blade 5 is established in the manner now to be described. Let $O_1$ = the center of the stationary blade 4, $O_2$ = the center of the movable blade 5, $P$ = the point of contact between the two blades, $r_1$ = radius of edge circle of the stationary blade, $r_2$ = that of the movable blade, and $d$ = the distance between the centers $O_1$ and $O_2$. Then, the angle the both blades made as they meet at the point P is $<O_1PO_2$, and the following relation holds between the angle $\theta$, on one hand, and the radii $r_1$, $r_2$ and the center distance $d$, on the other hand:

$$\Theta = \mathrm{Cos}^{-1}\frac{r_1^2 + r_2^2 - d^2}{2r_1r_2}.$$

The fact that the difference between the radii $r_1$ and $r_2$, or $|r_1 - r_2|$, is smaller than the center distance $d$ is the condition which allows the stationary blade 4 and the movable blade 5 to meet at only a contact point P along the circumference of the edge circle of the stationary blade 4 during each instant of the cutting operation.

This condition combines with the pressure contact attainable through the use of spring means to give a cutter with improved sharpness and prolonged service life. The capacity of the cutter may be changed by choosing a suitable angle $\theta$ (of cutting).

Figure 3:
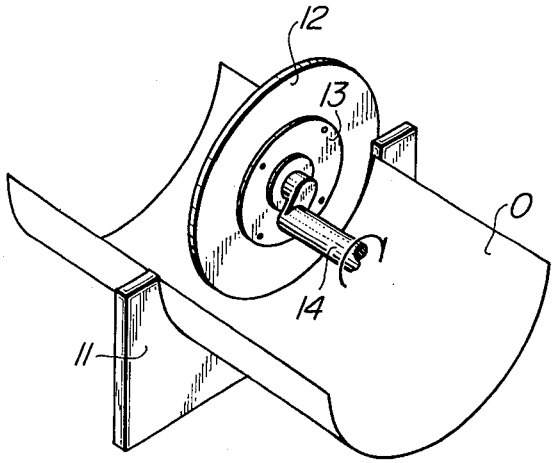
FIGS. 3 to 5 are perspective, front, and side views, respectively, of an embodiment of the invention.
Figure 4:
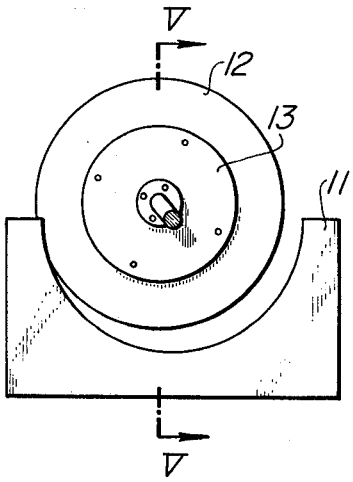
Figure 5:
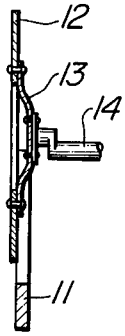

The invention will more fully be described hereunder in connection with a few embodiments thereof. Referring to FIGS. 3 through 5, there is shown a stationary blade 11 having a semicircular receding contour with the same radius of curvature as that of a sheet of semicylindrically curled paper O, which measures 100 mm. Also, a movable blade 12 having a circular contour with a radius of 98 mm is shown as mounted via a Belleville spring 13 on an eccentric shaft 14. The distance between the center of radius of the stationary blade 11 and that of the movable blade 12 is 10 mm. The movable blade is pressed against the stationary one edgewise by the force of the spring 13. The eccentric shaft 14 is supported by bearings not shown, and a prime mover not shown is drivingly coupled to the shaft, permitting the two blades to remain in contact always at only one point at each instant of the cutting operation as the movable blade moves relative to the stationary blade during the cutting operation. This ensures long cutter life and unabated sharpness.

Figure 6:
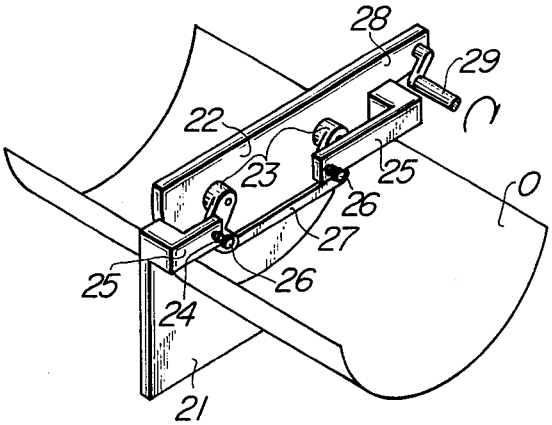
FIGS. 6 to 8 are similar view of another embodiment.
Figure 7:
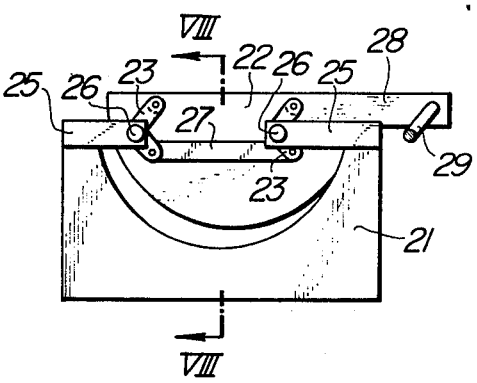
Figure 8:
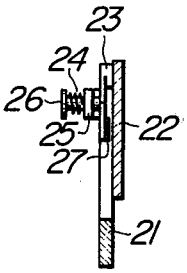

FIGS. 6 through 8 show another embodiment of the invention in which a movable blade is driven. Like the embodiment described above, this one comprises a stationary blade 21 with a radius of 100 mm, and a movable blade 22 with a radius of 98 mm, the distance between the blade centers being 10 mm. Two links 23 are made fast at one ends to the movable blade and turnably connected at the other ends to brackets 25 formed in one piece with the stationary blade by pins 26 each of which is loaded with a spring 24, so that the movable blade is in pressure contact edgewise with the stationary blade. A center link 27 is provided lest the motion of the movable blade should become unstable with the arrival of the links 23 at their change points. Since the movable blade runs in parallel with the stationary one, the driving mechanism may be attached to any suitable part of the blade. In the embodiment being described, an eccentric shaft 29 fast on a handlelike extension 28 of the movable blade is supported by bearings not shown and is driven by a prime mover such as a motor not shown. The blades thus cut the paper O well and have remarkably elongated life.

Figure 9:
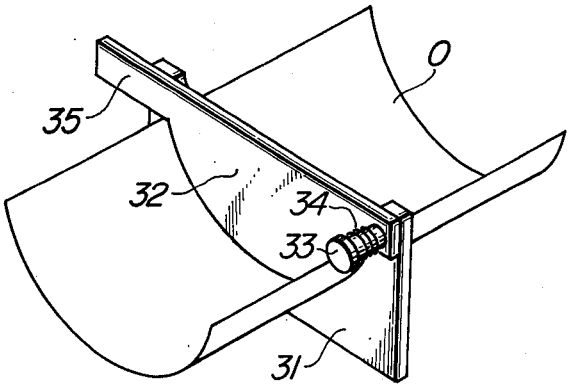
FIGS. 9 to 11 are similar views of still another embodiment.
Figure 10:
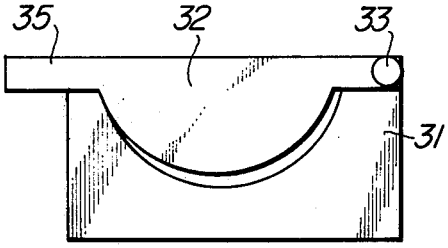
Figure 11:
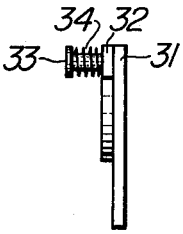

Still another embodiment wherein a movable blade is driven is shown in FIGS. 9 and 11. Here the radius of the stationary blade 31 is set to 100 mm, the radius of the movable blade 32 to 96 mm, and the center distance to 6 mm. The both blades are hingedly connected at one ends by a pin 33. A spring 34 coiled round the stem of the pin 33 forces the movable blade into pressure contact with the stationary one. The movable blade is extended at one end beyond the stationary blade to form a handle 35 for manual cutting of the paper O. Like the preceding embodiments, this construction has equally good cutting quality and outstanding durability.

While the movable blades of the embodiments so far described have a circular or semicircular contour, they may take any other shape provided that the contour is rounded to at least a semicircle.

As has been stated, the present invention resides in a paper cutter of good cutting quality, durability, and simple construction, comprising a combination of a stationary blade having a semicircularly receding contour and a movable blade having an at least semicircular contour, and spring means forcing the movable blade in pressure contact edgewise with the stationary blade, enabling the both blades to be positively in contact only at one point as the movable blade moves relative to the stationary blade during the cutting operation and cutting is always performed at one such point.

What is claimed is:

1. A cutter adapted for cutting paper or the like in a semicylindrically curled state, comprising a stationary blade having a cutting edge of semicircular concave contour, a movable blade having a cutting edge with a semicircular convex periphery, a spring-loaded pin means pivotally connecting the stationary and movable blades at one end for forcing both blades in pressure contact with each other, wherein the movable blade has a handle at its other end for a manual cutting operation and the pivotal connection of the blades is outside the locus of points defining the concave and convex surfaces, and the radius of the semicircular periphery of the movable blade is smaller than the radius of the semicircular contour of the stationary blade and the centers of these radii are arranged such that the distance between the centers of the radii is greater than the difference between the blade radii so that the two blades are always in cutting contact at only one cutting point at any instant of time during a cutting operation and at the beginning of a cutting stroke the cutting edges are in single point contact at their ends opposite the pivotal connection.

* * * * *